United States Patent [19]

Simovits, Jr.

[11] Patent Number: 4,492,950

[45] Date of Patent: Jan. 8, 1985

[54] VARIABLE RESISTANCE ASSEMBLY WITH IMPROVED CONTACTOR KNOB

[75] Inventor: Stephen S. Simovits, Jr., Downers Grove, Ill.

[73] Assignee: American Plasticraft Company, Chicago, Ill.

[21] Appl. No.: 470,993

[22] Filed: Mar. 1, 1983

[51] Int. Cl.[3] ..... H01C 10/32

[52] U.S. Cl. ..... 338/162; 338/134; 338/184; 338/199; 338/202

[58] Field of Search ..... 338/162, 160, 163, 164, 338/167, 170, 174, 184, 134, 199, 202

[56] References Cited

U.S. PATENT DOCUMENTS

| | | | |
|---|---|---|---|
| 2,974,299 | 3/1984 | Youngbeck et al. | 338/163 |
| 3,096,499 | 7/1963 | Hudson | 338/163 |
| 3,387,247 | 6/1968 | Mishler | 338/184 X |
| 3,599,140 | 8/1971 | Ichikawa et al. | 338/162 X |
| 3,902,152 | 7/1975 | Van Benthuysen | 338/162 |
| 3,909,769 | 9/1975 | Rozema et al. | 338/163 X |
| 3,970,986 | 7/1976 | Seyler et al. | 338/167 X |
| 4,219,796 | 7/1980 | Nishizawa | 338/163 |
| 4,306,216 | 12/1981 | Azema et al. | 338/184 |

FOREIGN PATENT DOCUMENTS

| | | | |
|---|---|---|---|
| 1420779 | 1/1976 | United Kingdom | 338/162 |

OTHER PUBLICATIONS

Whitefield, "Low Cost, High Voltage Potentiometers", Electron (GB), #89, Feb. 12, 1976, pp. 51–52.

*Primary Examiner*—Roy N. Envall, Jr.
*Assistant Examiner*—C. N. Sears
*Attorney, Agent, or Firm*—Leo J. Aubel

[57] ABSTRACT

A thick film variable resistance assembly, such as for a cathode ray tube, having an improved contactor knob.

4 Claims, 4 Drawing Figures

VARIABLE RESISTANCE ASSEMBLY WITH IMPROVED CONTACTOR KNOB

TECHNICAL FIELD

The invention pertains to an improved thick film variable resistance assembly functionable as a voltage divider to provide a selected voltage to selected anodes of a cathode ray tube.

BACKGROUND OF THE INVENTION

In present cathode ray tubes such as for use as television picture tubes, it is desirable to provide an assembly to control and adjust the voltage provided to various anodes. Numerous types of prior art resistance assemblies functioning as variable voltage dividers have been provided for this purpose. Such voltage dividers usually comprise resistance elements, contacts adjustably engaging the resistance elements, a contactor knob for changing the position of the contactor relative to the resistance elements, and several terminals for connecting the voltage divider to the associated electronic circuitry.

Resistance elements for such use may be of the so-called thick-film type, which comprises a resistive material deposited on a ceramic substrate. An adjustable electrical contactor may be mounted on the substrate to vary the point at which the contactor contacts the resistive material to thus vary the voltage output from said resistive elements.

SUMMARY OF INVENTION

The invention is directed to an improved thick film variable resistance assembly, including an improved contactor knob, for providing an adjustably selectable voltage, particularly to the focus and G-2 anodes of a television picture tube.

DESCRIPTION OF DRAWINGS

The foregoing features and advantages of the present invention will be apparent from the following more particular description of the invention. The accompanying drawings, listed hereinbelow, are useful in explaining the invention wherein.

DESCRIPTION OF THE INVENTION

Figure 1:
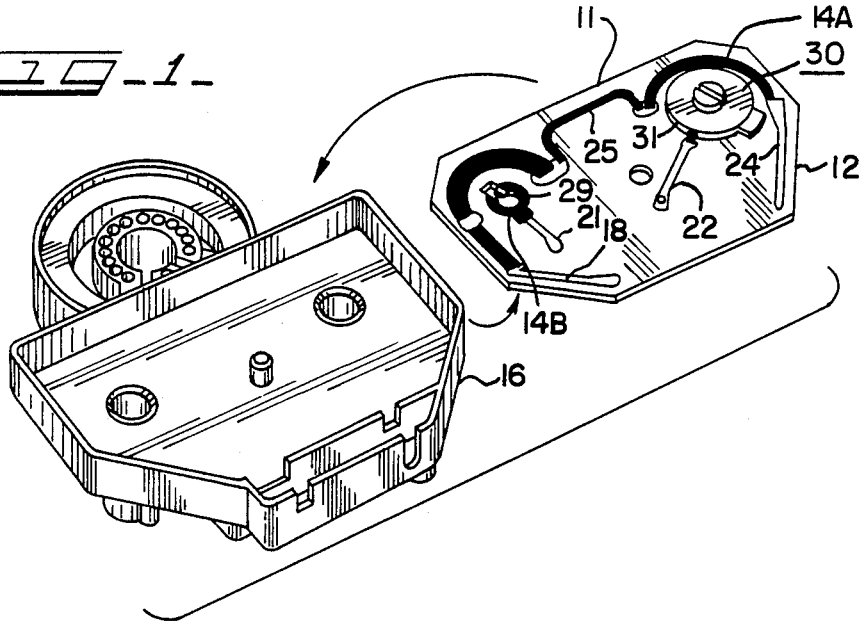
FIG. 1 is an exploded isometric view of the substrate portion of a variable resistance assembly.

Referring now to the drawings, FIG. 1 illustrates the inventive variable resistance assembly 11, which comprises a ceramic substrate 12, which may be formed of a suitable material such as alumina. The substrate 12 may have any suitable shape; and, in the embodiment shown, comprises a modified rectangle to conform to an associated housing 16. Note that, in assembly, substrate 12 is turned over, as indicated by the arrowed lines, and fit into housing 16.

Electrically-resistive paths, generally labeled 14, are deposited on the substrate 12 in a desired pattern. The resistive paths 14 each comprise a thick film; that is, a composite of electrically-resistive material with a suitable dispersion of metal. Any one of several commercially available materials may be used to form the thick film.

As can be seen in FIG. 1, the resistive path 14A has one end electrically in contact with a high voltage terminal pad 18. Pad 18 is formed of a metallic base material, which is deposited by any suitable known means onto the ceramic substrate 12. A second terminal pad 24, similar to pad 18, connects the opposite end of resistive path 14A to ground reference. Another terminal pad 21 connects to resistive path 14B and couples a voltage from path 14A through an associated contactor, not shown but similar to contactor knob 31, to the focus anode (not shown) of an associated cathode ray tube (CRT), as will be described. Another terminal pad 22 connects to a resistive path and couples a voltage from path 14A through contactor knob 31 to another anode of the CRT to provide a voltage thereto similarly as above.

A pair of key slots (slot 29 only being shown in FIG. 1) each accommodate the contactor knobs 31 (only one being shown in FIG. 1), as will be explained.

Figure 3:
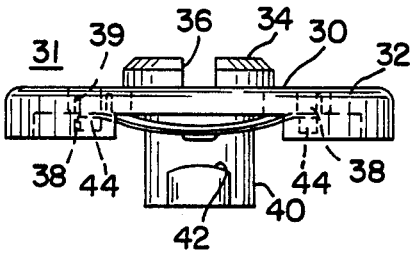
FIG. 3 is a side view of the contactor of FIG. 2.
Figure 2:
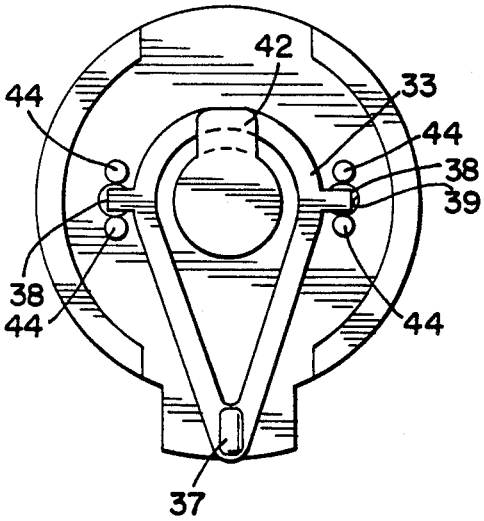
FIG. 2 is a bottom view of the rotatably-adjustable electrical contactor for the variable resistance assembly.
Figure 4:
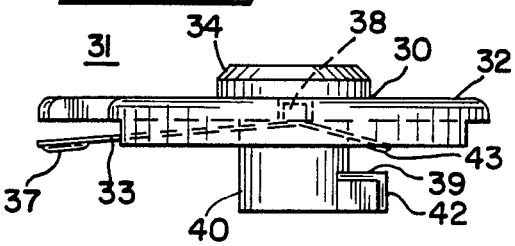
FIG. 4 is another side view of the contactor of the invention.

An electrical contactor assembly 30, which includes the contactor knob 31, is mounted for rotation adjacent resistive path 14A to electrically contact to the resistive path, as will be explained hereinbelow. The details of the contactor assembly 30 are shown in FIGS. 2, 3 and 4.

Contactor knob 31 is of a suitable nonconductive material (such as of commercially available LEXAN®), and has a body portion 32. A central projection 34, extending upwardly from body 32, includes a slit 36 for accommodating a screwdriver-type tool for adjusting the rotational position of contactor knob 31. A leaf spring 33, of a tear-drop loop shape, has two upwardly-extending projections 38 (see FIGS. 3 and 4) which are received in recesses 39 formed in the lower surface of body portion 32 to retain spring 33 in position. Conductive pads 37 and 43 are formed at the opposite ends of the leaf spring 33 to make electrical contact with the resistive paths 14A and 14B, respectively. Leaf spring 33 is biased downwardly (see FIG. 3); and, when contactor 31 is positioned on substrate 12, the body portion 32 will force downwardly against spring 33 to bias pads 37 and 43 against the resistive paths 14.

Contactor knob 31 includes a central circular mounting post 40 extending downwardly from body 32. Post 40 includes a transversely-extending projection 42, to form an L-shaped configuration with post 40, as best seen in FIG. 4. Projection 42 may have a convex upper surface 39 to provide a smoother rotating action against substrate 12, as will be explained. In the embodiment shown, shoulder or horizontal leg 42 extends in the opposite direction from the contact 37 on leaf spring 31.

Referring back to FIG. 1, the key slot 29 on substrate 12 preferably extends in a manner not to register with the shoulder 42; that is, a maximum adjustment of the contactor knob 31 on resistive path 14A will not cause the projection 42 to align with keyway slot 29; thus, body 32 will be retained in position and be prevented from slipping out. When initially inserting contactor knob 31 in substrate 12, shoulder 42 is pushed through slot 29 and contactor 31 is turned to cause the upper surface 39 of post 40 to engage the undersurface of substrate 12. The contactor 31 is then rotated until the contact tip 37 contacts the resistive path 14A.

When the contactor 31 is mounted in position in assembly 11, the leaf spring 33 will be resiliently compressed against the planar surface of the substrate 12 to thus make contact with the resistive path 14. The contactor knob 31 is manually rotatable to be set at a selected position. As mentioned above, the upper surface 39 of shoulder 42 provides for smooth rotation against substrate 12. The positioning or setting of contactor 31 thus controls the voltage output on terminal 21 to one of the anodes.

As mentioned, variable resistance assembly 11 is particularly suitable for use in the circuits of a cathode ray tube. In a typical color television picture tube application, the input to the variable resistive assembly 11 is connected to terminal pad 21 as a DC voltage of, say, approximately 25 KV volts; and the low potential termination is connected to ground reference terminal pad 24. A voltage output is connected from terminal pad 21 to the focus anode of the picture tube. The tube is then focused by adjusting the associated contactor 31 (not shown in FIG. 1) until a voltage in the range of 0–20 KV is applied to the focus anode of the tube. Another voltage output is connected from the other terminal pad 22 through contactor 31 (shown) to provide a voltage to the G-2 anode. Note that the contactor knob may be easily and inexpensively formed; and it provides a positive engagement with the substrate.

While the invention has been particularly shown and described with reference to a preferred embodiment thereof, it will be understood by those skilled in the art that various changes in form and details may be made therein without departing from the spirit and scope of the invention.

I claim:

1. A variable resistance assembly functioning as a voltage divider for a cathode ray tube comprising: an electrically nonconductive substantially flat substrate having terminal pads connectable to a source of voltage; an electrically-resistive path on said substrate; a key slot adjacent said resistive path; a contactor assembly including a contactor knob, a resilient conductive spring mounted on said knob and having a portion engaging said resistive path, an L-shaped mounting post on said contactor, said post conforming to said key slot and extending therethrough from one surface to the opposite surface of said substrates, the horizontal leg of said L-shaped post engaging the opposite surface of said substrate to retain said contactor on said substrate, and said contactor being rotatably adjustable to vary the point of contact of said spring with said resistive path and, hence, the effective voltage coupled therefrom.

2. An assembly as in claim 1, wherein said post comprises a cylindrical vertical arm and a horizontally-extending arm having a convex upper surface.

3. An assembly as in claim 1, wherein the keyslot is configured to be in opposing registering position with the L-shaped post when said spring is in contact with said resistive path.

4. An assembly as in claim 1, further including two resistive paths, and said spring providing electrical contact therebetween.

* * * * *